US006892812B2

(12) United States Patent
Niedermayr et al.

(10) Patent No.: US 6,892,812 B2
(45) Date of Patent: May 17, 2005

(54) AUTOMATED METHOD AND SYSTEM FOR DETERMINING THE STATE OF WELL OPERATIONS AND PERFORMING PROCESS EVALUATION

(75) Inventors: Michael Niedermayr, Stafford, TX (US); Mitchell D. Pinckard, Houston, TX (US); Gerhard P. Glaser, Houston, TX (US)

(73) Assignee: Noble Drilling Services Inc., Sugar Land, TX (US)

( * ) Notice: Subject to any disclaimer, the term of this patent is extended or adjusted under 35 U.S.C. 154(b) by 0 days.

(21) Appl. No.: 10/153,845

(22) Filed: May 21, 2002

(65) Prior Publication Data

US 2003/0220742 A1 Nov. 27, 2003

(51) Int. Cl.[7] ..... E21B 44/00

(52) U.S. Cl. ..... 166/250.15; 166/53; 175/24; 175/40; 702/9

(58) Field of Search ..... 175/24–38, 40; 166/250.15, 53; 702/9; 340/854.1, 856.1, 856.3; 73/152.43, 152.19

(56) References Cited

U.S. PATENT DOCUMENTS

| | | | | |
|---|---|---|---|---|
| 3,541,852 A | * | 11/1970 | Brown et al. | 73/152.19 |
| 4,282,939 A | | 8/1981 | Maus et al. | 175/7 |
| 4,354,233 A | * | 10/1982 | Zhukovsky et al. | 175/27 |
| 4,507,735 A | | 3/1985 | Moorehead et al. | 364/422 |
| 4,610,161 A | | 9/1986 | Gehrig et al. | 73/155 |
| 4,649,388 A | | 3/1987 | Atlas | 342/26 |
| 4,802,143 A | | 1/1989 | Smith | 367/82 |
| 4,825,962 A | * | 5/1989 | Girault | 175/26 |
| 4,852,665 A | * | 8/1989 | Peltier et al. | 175/40 |
| 4,875,530 A | * | 10/1989 | Frink et al. | 175/27 |
| 4,876,886 A | | 10/1989 | Bible et al. | 73/151.1 |
| 5,063,776 A | | 11/1991 | Zanker et al. | 73/155 |

(Continued)

FOREIGN PATENT DOCUMENTS

| | | | |
|---|---|---|---|
| EP | 0 437 872 A2 | 7/1991 | G01F/1/100 |
| WO | WO 02/50398 A1 | 6/2002 | E21B/21/08 |

OTHER PUBLICATIONS

Hutchinson, et al., "*An MWD Downhole Assistant Driller*", Society of Petroleum Engineers, SPE #30523, vol. 30523, pp. 743–752, XP000618424.

PCT International Search Report for PCT US03/15525, 8 pages.

J. M. Speers et al., "Delta Flow: An Accurate, Reliable System for Detecting Kicks and Loss of Circulation During Drilling," *SPE Drilling Engineering*, Dec. 1987, 5 pages.

(Continued)

*Primary Examiner*—David Bagnell
*Assistant Examiner*—Matthew J. Smith
(74) *Attorney, Agent, or Firm*—Baker Botts L.L.P.

(57) ABSTRACT

An automated method and system for determining the state of a drilling or other suitable well operations includes storing a plurality of states for the well operation. Mechanical and hydraulic data is received for the well operation. Based on the mechanical and hydraulic data, one of the states is automatically selected as the state of the well operation. Process evaluation may be performed based on the state of the well operation.

115 Claims, 6 Drawing Sheets

U.S. PATENT DOCUMENTS

| | | | | | |
|---|---|---|---|---|---|
| 5,154,078 | A | | 10/1992 | Codazzi | 73/155 |
| 5,222,048 | A | | 6/1993 | Grosso et al. | 367/32 |
| 5,303,328 | A | | 4/1994 | Masui et al. | 395/23 |
| 5,413,750 | A | | 5/1995 | Kelman et al. | 264/517 |
| 5,454,436 | A | | 10/1995 | Jardine et al. | 175/40 |
| 5,465,321 | A | | 11/1995 | Smyth | 395/22 |
| 5,465,798 | A | * | 11/1995 | Edlund et al. | 175/24 |
| 5,469,369 | A | | 11/1995 | Rose-Pehrsson et al. | 364/497 |
| 5,474,142 | A | * | 12/1995 | Bowden | 175/27 |
| 5,539,704 | A | | 7/1996 | Doyen et al. | 367/73 |
| 5,654,503 | A | * | 8/1997 | Rasmus | 73/152.43 |
| 5,659,135 | A | | 8/1997 | Cacas | 73/152.02 |
| 5,699,246 | A | | 12/1997 | Plasek et al. | 364/422 |
| 5,730,234 | A | | 3/1998 | Putot | 175/50 |
| 5,952,569 | A | | 9/1999 | Jervis et al. | 73/152.01 |
| 5,978,739 | A | | 11/1999 | Stockton | 702/6 |
| 6,026,912 | A | | 2/2000 | King et al. | 175/27 |
| 6,152,246 | A | | 11/2000 | King et al. | 175/26 |
| 6,155,357 | A | | 12/2000 | King et al. | 175/27 |
| 6,192,980 | B1 | * | 2/2001 | Tubel et al. | 166/53 |
| 6,192,998 | B1 | | 2/2001 | Pinckard | 175/27 |
| 6,233,524 | B1 | * | 5/2001 | Harrell et al. | 702/9 |
| 6,250,395 | B1 | | 6/2001 | Torres | 166/382 |
| 6,253,860 | B1 | * | 7/2001 | Poysti et al. | 175/27 |
| 6,257,354 | B1 | | 7/2001 | Schrader et al. | 175/38 |
| 6,293,356 | B1 | | 9/2001 | King et al. | 175/27 |
| 6,371,204 | B1 | | 4/2002 | Singh et al. | 166/250.03 |
| 6,382,331 | B1 | | 5/2002 | Pinckard | 175/27 |
| 6,443,242 | B1 | | 9/2002 | Newman et al. | 175/57 |
| 6,474,422 | B2 | | 11/2002 | Schubert et al. | 175/69 |
| 6,484,816 | B1 | | 11/2002 | Koederitz | 175/25 |
| 6,574,565 | B1 | * | 6/2003 | Bush | 702/14 |
| 6,662,110 | B1 | * | 12/2003 | Bargach et al. | 702/9 |
| 2002/0120401 | A1 | * | 8/2002 | Macdonald et al. | 702/6 |

OTHER PUBLICATIONS

S. I. Jardine et al., "An Improved Kick Detection System for Floating Rigs," SPE 23133, *Society of Petroleum Engineers, Inc.*, 1991, 8 pages.

Weishaupt et al., "Rig Computer System Improves Safety for Deep HP/HT Wells by Kick Detection and Well Control Monitoring," SPE 23053, *Society of Petroleum Engineers, Inc.*, 1991, 8 pages.

Harmse et al., "Intelligent Drilling Monitor Detects Downhole Problems," *GasTIPS*, Feb. 2000, 7 pages.

G. P. Corser et al., "Field Test Results for a Real–Time Intelligent Drilling Monitor," IADC/SPE 59227, *International Association of Drilling Contractors* and *Society of Petroleum Engineers*, Feb. 2000, 12 pages.

Hargreaves et al., "Early Kick Detection for Deepwater Drilling: New Probabilistic Methods Applied in the Field," SPE 71369, *Society of Petroleum Engineers Inc.*, 2001, 11 pages.

G. Martin Milner et al., "Data Processing and Interperation While Drilling, " AADE 01–CH–HO–38, *American Association of Drilling Engineers*, 2001, 14 pages.

"WW Advanced Kick Detection Package" information brochure, *Datalog*, 2001, 4 pages.

"Well Stability Analyzer™" Brochure, *National Oilwell*, date unknown, 1 page.

U.S. Appl. No. 10/229,470; entitled "Automated Method and System for Recognizing Well Control Events," filed Aug. 27, 2002, 104 total pages.

C.P. Leach et al., "Use of a Kick Stimulator as a Well Planning Tool," *Society of Petroleum Engineers, Inc.*, 1992, 9 pages.

D. Dashevskiy, et al., "Application of Neural Networks for Predictive Control in Drilling Dynamics," *Society of Petroleum Engineers.*, 1999, 8 pages.

G.M. Milner, "Real–Time Well Control Advisor", *Society of Petroleum Engineers, Inc.*, 1992, 9 pages.

G.M. Lloyd, et al., "Practical Application of Real–Time Expert System for Automatic Well Control," *Society of Petroleum Engineers, Inc., International Association of Drilling Contractors*, 1990, 12 pages.

A.J. Mansure et al., "A Probabilistic Reasoning Tool for Circulation Monitoring Based on Flow Measurements," *Society of Petroleum Engineers, Inc.*, 1999, 12 pages.

B.W. Swanson et al. "Slimhole Early Kick Detection by Real–Time Drilling Analysis," *Society of Petroleum Engineers*, 1983, 11 pages.

Bode, D.J., SPE, et al., "*Well–Control Methods and Practices in Small–Diameter Wellbores*", JPT, Nov. 1991, pp. 1380–1386, with 4 pages of additional figures.

* cited by examiner

AUTOMATED METHOD AND SYSTEM FOR DETERMINING THE STATE OF WELL OPERATIONS AND PERFORMING PROCESS EVALUATION

TECHNICAL FIELD

This invention relates generally to the field of drilling management systems, and more particularly to an automated method and system for determining the state of drilling and other well operations and performing process evaluation.

BACKGROUND

Drilling rigs are typically rotary-typed rigs that use a sharp bit to drill through the earth. At the surface, a rotary drilling rig often includes a complex system of cables, engines, support mechanisms, tanks, lubricating devices, and pulleys to control the position and rotation of the bit below the surface.

Underneath the surface, the bit is attached to a long drill pipe which carries drilling fluid to the bit. The drilling fluid lubricates and cools the bit, as well as removes cuttings and debris from the well bore. In addition, the drilling fluid provides a hydrostatic head of pressure that prevents the collapse of the well bore until it can be cased and that prevents formation fluids from entering the well bore, which can lead to gas kicks and other dangerous situations.

Automated management of drilling rig operations is problematic because parameters may change quickly and because down hole behavior of drilling elements and down hole conditions may not be directly observable. As a result, many management systems fail to accurately recognize the presence and/or absence of important drilling events, which may lead to false alarms and unnecessary down time.

SUMMARY

The present invention provides an automated method and system for determining the state of drilling and other well operations. Process evaluation may be performed for the operation based on the state and dynamic data for the operation. In a particular embodiment, the present invention determines the state of drilling operations based on bit behavior to allow accurate and timely event recognition during drilling operations. In other embodiments, the present invention determines the state of work over, completion, testing, abandonment, intervention and/or other well operations of the drilling industry based on sensed, verified, inferred and/or determined mechanical and hydraulic data.

In accordance with one embodiment of the present invention, an automated method for monitoring the state of a well operation comprises storing a plurality of states for the well operation. Mechanical and hydraulic data is sensed and reported for the well operation. Based on the mechanical and hydraulic data, one of the states is automatically selected as the state of the well operation. The state may be used for process evaluation, decision making and control functionality.

Technical advantages of some embodiments of the present invention include providing an automated method and system for determining the state of a well operation based on mechanical and/or hydraulic data sensed, inferred, and/or determined for the operation. The data may be sensed and processed down hole and/or at the surface and in connection with operations for the well. As a result, well reporting, management or event recognition may be automatically provided in connection with the well operation.

Another technical advantage of some embodiments of the present invention includes providing an automated method and system for effectively determining the state of a drilling operation. In particular, the drilling, tripping, reaming, testing, and/or conditioning state of a rig may be determined in real time and used for reporting, event recognition and/or rig management.

Still another technical advantage of some embodiments of the present invention includes providing an improved drilling or other rig used for well operations. In particular, sensed and/or reported data is utilized to enhance accuracy. In addition, the automated and real time state determination may allow for earlier, more effective and more efficient recognition of potentially hazardous events such as kickouts, stuck pipe, and pack off, thus resulting in the more effective taking of corrective operations and a reduction in the frequency and severity of undesirable events.

It will be understood that the various embodiments of the present invention may include some, all, or none of the enumerated technical advantages. In addition, other technical advantages of the present invention may be readily apparent from the following figures, description and claims.

BRIEF DESCRIPTION

For a more complete understanding of the present invention and its advantages, reference is now made to the following description, taken in conjunction with the accompanying drawings, in which.

Figure 5A:
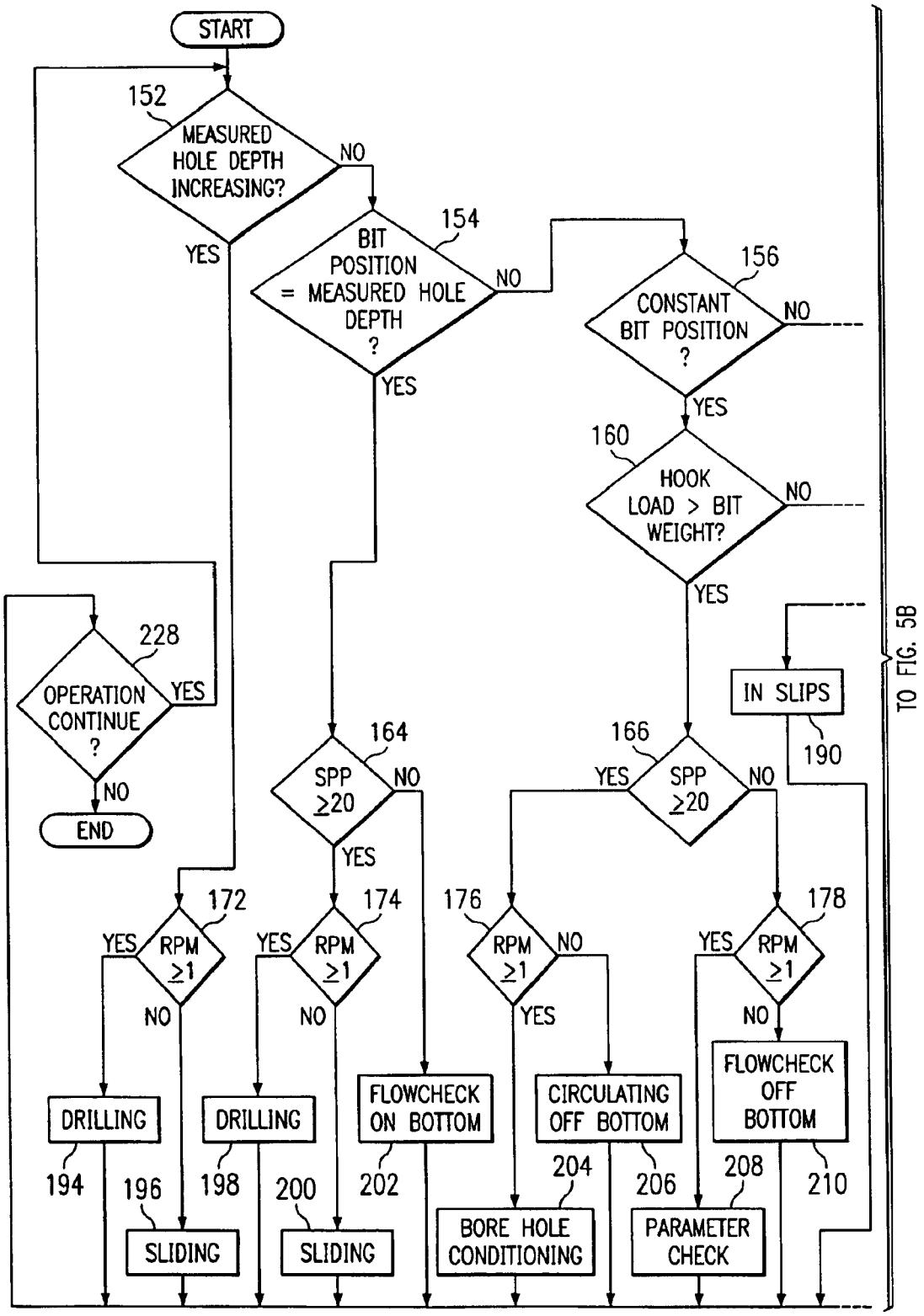
Figure 5B:
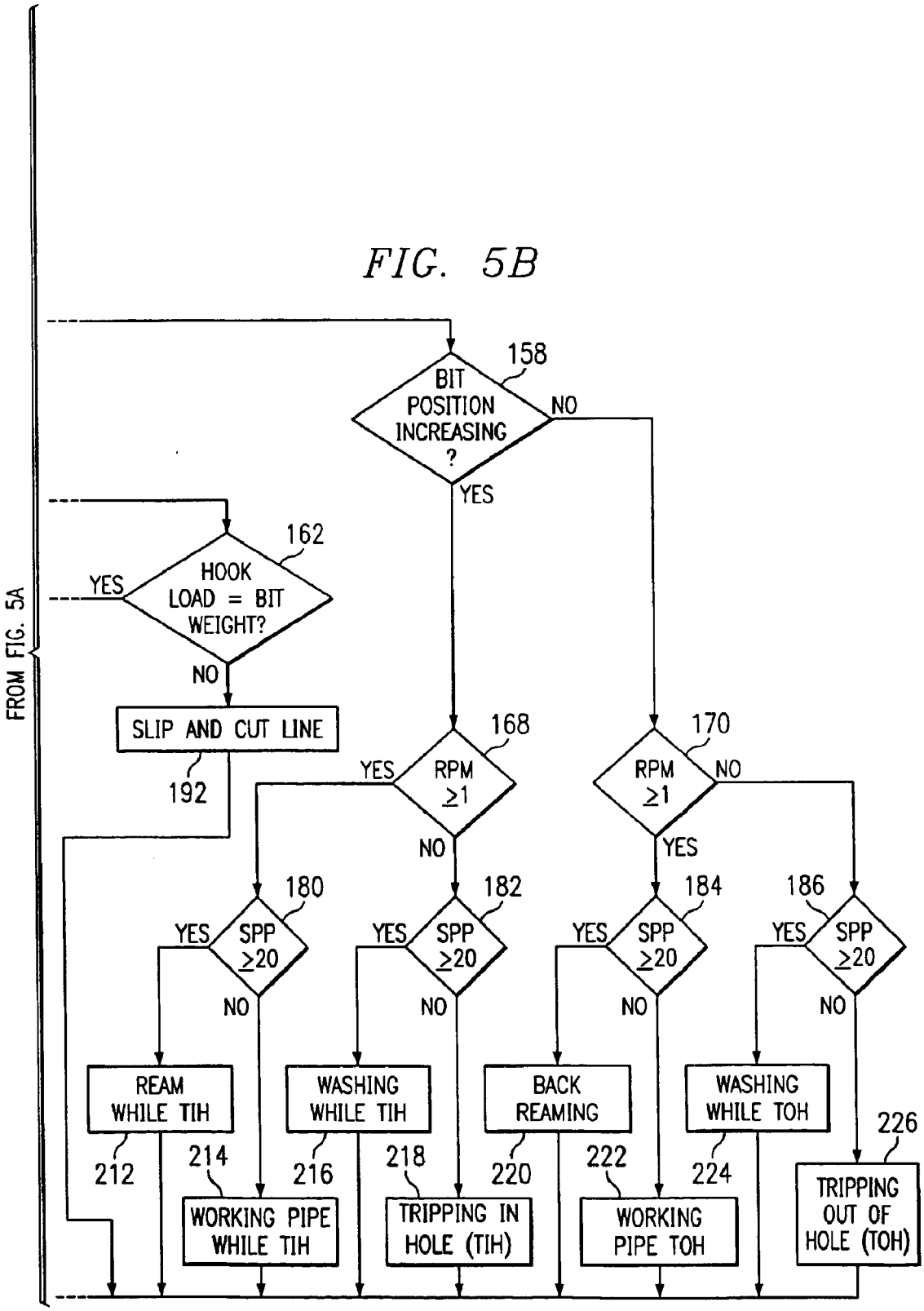
Figure 6:
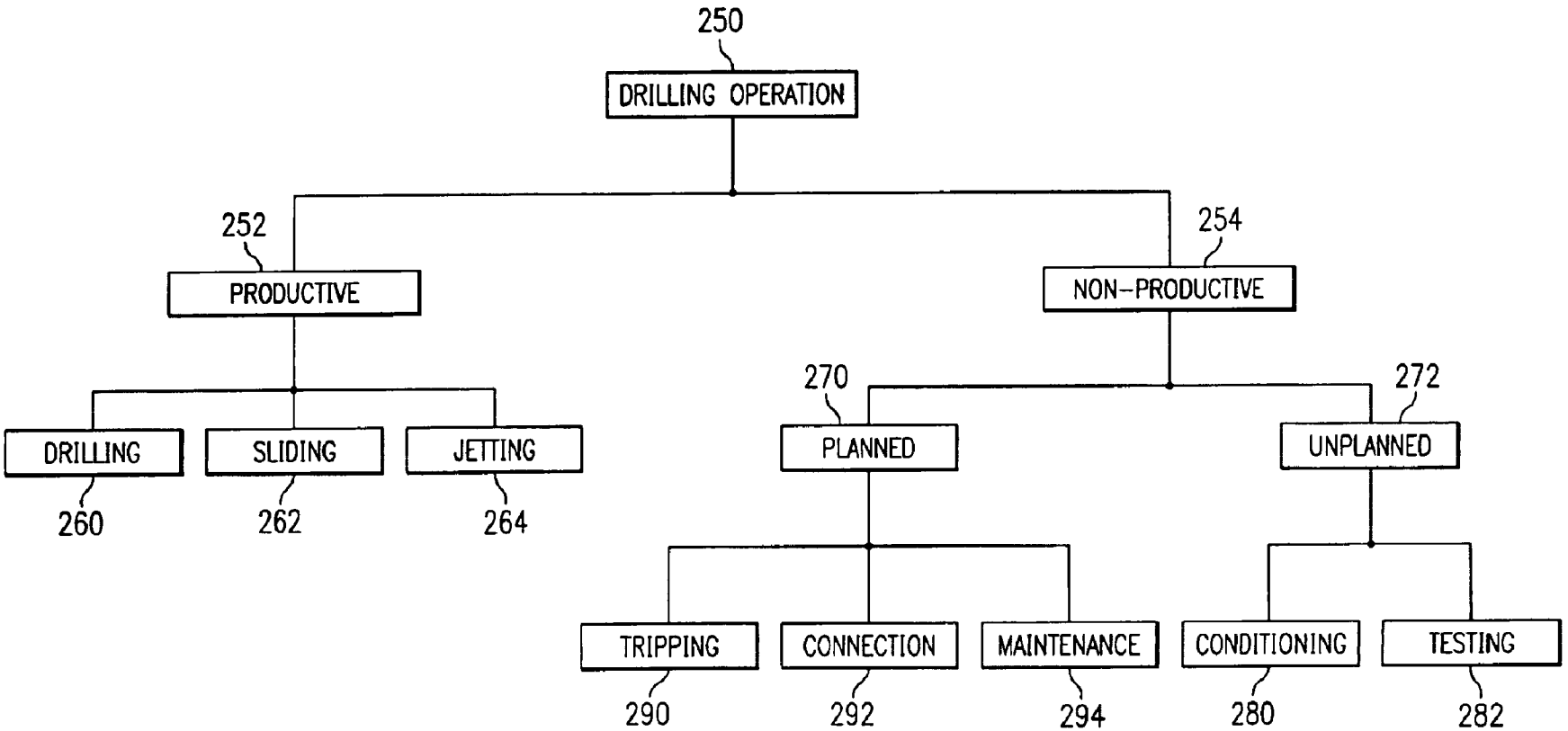

FIGS. 5A–B are flow diagrams illustrating a method for determining the state of a drilling operation in accordance with another embodiment of the present invention; and FIG. 6 is a block diagram illustrating states for a drilling operation in accordance with another embodiment of the present invention.

DETAILED DESCRIPTION

The present invention provides an automated method and system for determining the state of well operations. In one embodiment, as described with particularity below, the present invention may be used to automatically determine the state of drilling operations. In other embodiments, as also described below, the present invention may be used to determine the state of mud fluid circulation and other drilling systems or subsystems, as well as the state of other suitable well operations. For example, the state engine of the present invention may be used to determine the status of work over, completion, re-entry, tubing runs and exchanges as well as other suitable well operations. The well operations may be rig-performed operations with a rig on site or other activity performed over the life of an oil, gas or other suitable well. In each of these embodiments, the well operations are typically complex processes in which state determination involves a number of parameters from a number of systems and/or locations. For example, a drilling operation may include parameters measured and/or representing surface as well as down hole conditions and equipment. The state determination may be based on mechanical and hydraulic data, may be determined to a high resolution and/or may be determined based on input from a number of systems. Thus, the state engine may provide comprehensive state determination in order to support control evaluation and/or decision making functionality for a well operation. Control evaluation and/or decision making functionally is supported, in one embodiment, where operational conditions and status are provided and determined to allow accurate and automatic control of all, a substantial portion or at least a majority of aspects of well operations with little or no direct input from human operators.

Figure 1:
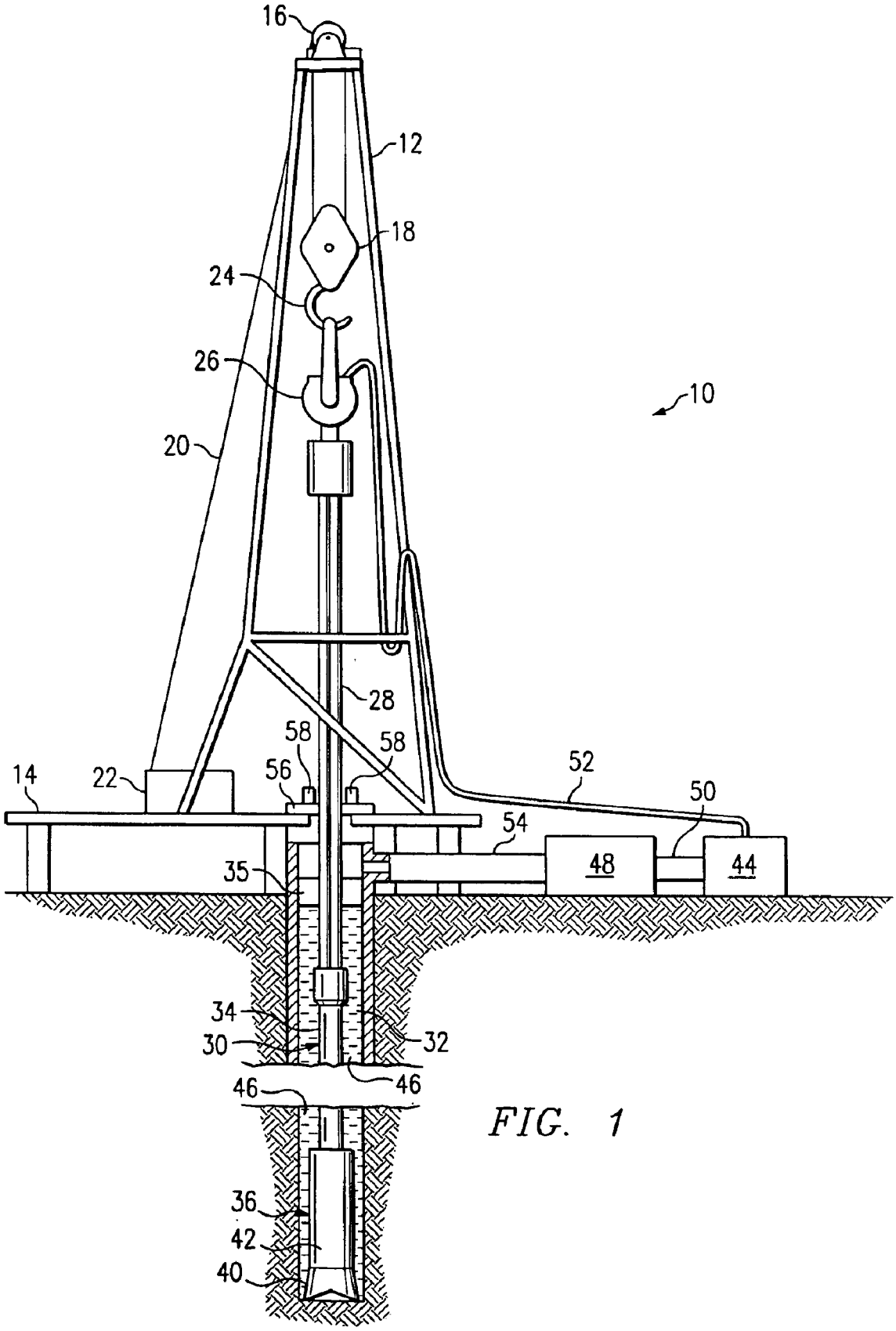
FIG. 1 is a schematic diagram of a drilling rig in accordance with one embodiment of the present invention.

FIG. 1 illustrates a drilling rig 10 in accordance with one embodiment of the present invention. In this embodiment, the rig 10 is a conventional rotary land rig. However, the present invention is applicable to other suitable drilling technologies and/or units, including top drive, power swivel, down hole motor, coiled tubing units, and the like, and to non-land rigs, such as jack up rigs, semisubmersables, drill ships, mobile offshore drilling units (MODUs), and the like that are operable to bore through the earth to resource-bearing or other geologic formations.

The rig 10 includes a mast 12 that is supported above a rig floor 14. A lifting gear includes a crown block 16 mounted to the mast 12 and a travelling block 18. The crown block 16 and the travelling block 18 are interconnected by a cable 20 that is driven by draw works 22 to control the upward and downward movement of the travelling block 18.

The travelling block 18 carries a hook 24 from which is suspended a swivel 26. The swivel 26 supports a kelley 28, which in turn supports a drill string, designated generally by the numeral 30 in the well bore 32. A blow out preventor (BOP) 35 is positioned at the top of the well bore 32. The string may be held by slips 58 during connections and rig-idle situations or at other appropriate times.

The drill string 30 includes a plurality of interconnected sections of drill pipe or coiled tubing 34 and a bottom hole assembly (BHA) 36. The BHA 36 includes a rotary drilling bit 40 and a down hole, or mud, motor 42. The BHA 36 may also include stabilizers, drill collars, measurement well drilling (MWD) instruments, and the like.

Mud pumps 44 draw drilling fluid, or mud, 46 from mud tanks 48 through suction line 50. The drilling fluid 46 is delivered to the drill string 30 through a mud hose 52 connecting the mud pumps 44 to the swivel 26. From the swivel 26, the drilling fluid 46 travels through the drill string 30 to the BHA 36, where it turns the down hole motor 42 and exits the bit 40 to scour the formation and lift the resultant cuttings through the annulus to the surface. At the surface, the mud tanks 48 receive the drilling fluid from the well bore 32 through a flow line 54. The mud tanks 48 and/or flow line 54 include a shaker or other device to remove the cuttings.

The mud tanks 48 and mud pumps 44 may include trip tanks and pumps for maintaining drilling fluid levels in the well bore 32 during tripping out of hole operations and for receiving displaced drilling fluid from the well bore 32 during tripping-in-hole operations. In a particular embodiment, the trip tank is connected between the well bore 32 and the shakers. A valve is operable to divert fluid away from the shakers and into the trip tank, which is equipped with a level sensor. Fluid from the trip tank can then be directly pumped back to the well bore via a dedicated centrifugal pump instead of through the standpipe.

Drilling is accomplished by applying weight to the bit 40 and rotating the drill string 30, which in turn rotates the bit 40. The drill string 30 is rotated within bore hole 32 by the action of a rotary table 56 rotatably supported on the rig floor 14. Alternatively or in addition, the down hole motor may rotate the bit 40 independently of the drill string 30 and the rotary table 56. As previously described, the cuttings produced as bit 40 drills into the earth are carried out of bore hole 32 by the drilling fluid 46 supplied by pumps 44.

Figure 2:
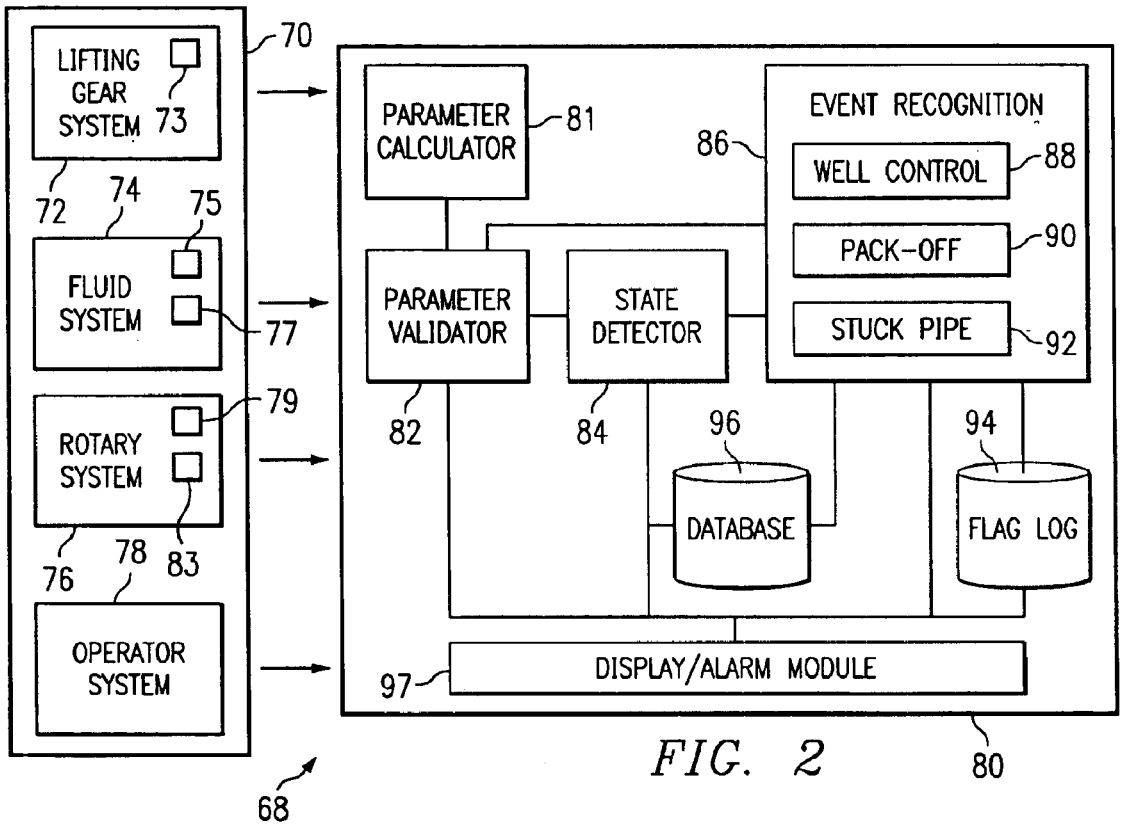
FIG. 2 is a block diagram of a monitoring system for a drilling operation in accordance with one embodiment of the present invention.

FIG. 2 illustrates a well monitoring system 68 in accordance with one embodiment of the present invention. In this embodiment, the monitoring system is a drilling monitoring system 68 for the rig 10. The monitoring system 68 comprises a sensing system 70 and a monitoring module 80 for drilling operations of the rig 10. Well monitoring systems for other well operations may comprise a sensing system with sensors similar, analogous or different to those of sensing system 70 for use in connection with a monitoring module, which may be similar, analogous or different than module 80. As described in more detail below, drilling operations may comprise drilling, tripping, testing, reaming, conditioning, and other and/or different operations, or states, of the drilling system. A state may be any suitable operation or activity or set of operations or activities of which all, some or most are based on a plurality of sensed parameters.

The sensing system 70 includes a plurality of sensors that monitor, sense, and/or report data, or parameters, on the rig 10, and/or in the bore hole 32. The reported data may comprise the sensed data or may be derived, calculated or inferred from sensed data.

In the illustrated embodiment, the sensing system 70 comprises a lifting gear system 72 that reports data sensed by and/or for the lifting gear; a fluid system 74 that reports data sensed by and/or for the drilling fluid tanks, pumps, and lines; rotary system 76 that reports data sensed by and/or for the rotary table or other rotary device; and an operator system 78 that reports data input by a driller/operator. As previously described, the sensed data may be refined, manipulated or otherwise processed before being reported to the monitoring module 80. It will be understood that sensors may be otherwise classified and/or grouped in the sensor system 70 and that data may be received from other additional or different systems, subsystems, and items of equipment. The systems that perform a well operation, which in some contexts may be referred to as subsystems, may each comprise related processes that together perform a distinguishable, independent, independently controllable and/or separable function of the well operation and that may interact with other systems in performing their function of the operation.

The lifting gear system 72 includes a hook weight sensor 73, which may comprise digital strain gauges or other sensors that report a digital weight value once a second, or at another suitable sensor sampling rate. The hook weight sensor may be mounted to the static line (not shown) of the cable 20.

The fluid system 74 includes a stand pipe pressure sensor 75 which reports a digital value at a sampling rate of the pressure in the stand pipe. The drilling fluid system may also include a mud pump sensor 77 that measures mud pump speed in strokes per minute, from which the flow rate of drilling fluids into the drill string can be calculated. Additional and/or alternative sensors may be included in the drilling fluid system 74 including, for example, sensors for measuring the volume of fluid in mud tank 46 and the rate of flow into and out of mud tank 46. Also, sensors may be included for measuring mud gas, flow line temperature, and mud density.

The rotary system 76 includes a rotary table revolutions per minute (RPM) sensor 79 which reports a digital value at a sampling rate. The RPM sensor may also report the direction of rotation. A rotary torque sensor 83 may also be included which measures the amount of torque applied to drill string 34 during rotation. The torque may be indicated by measuring the amount of current drawn by the motor that draws rotary table 46. The rotary torque sensor may alternatively sense the tension in the rotary table drive chain.

The operator system 78 comprises a user interface or other input system that receives input from a human operator/driller who may monitor and report observations made during the course of drilling. For example, bit position (BPOS) may be reported based upon the length of the drill string 30 that has gone down hole, which in turn is based upon the number of drill string segments the driller has added to the string during the course of drilling. The driller/operator may keep a tally book of the number of segments added, and/or may input this information in a Supervisory Control and Data Acquisition (SCADA) reporting system.

Other parameters may be reported or calculated from reported values. For example, other suitable hydraulic and/or mechanical data may be reported. Hydraulic data is data related to the flow, volume, movement, rheology, and other aspects of drilling or other fluid performing work or otherwise used in operations. The fluids may be liquid, gaseous or otherwise. Mechanical data is data related to support or physical action upon or of the drill string, bit or any other suitable device associated with the drilling or other operation. Mechanical and hydraulic data may originate with any suitable device operable to accept, report, determine, estimate a value, status, position, movement, or other parameter associated with a well operation. As previously described, mechanical and hydraulic data may originate from machinery sensor data such as motor states and RPMs and for electric data such as electric power consumption of top drive, mud transfer pumps or other satellite equipment. For example, mechanical and/or hydraulic data may originate from dedicated engine sensors, centrifugal on/off sensors, valve position switches, fingerboard open/close indicators, SCR readings, video recognition and any other suitable sensor operable to indicate and/or report information about a device or operation of a system. In addition, sensors for measuring well bore trajectory, and/or petrophysical properties of the geologic formations, as well down hole operating parameters, may be sensed and reported. Down hole sensors may communicate data by wireline, mud pulses, acoustic wave, and the like. Thus, the data may be received from a large number of sources and types of instruments, instrument packages and manufacturers and may be in many different formats. The data may be used as initially reported or may be reformatted and/or converted. In a particular embodiment, data may be received from two, three, five, ten, twenty, fifty, a hundred or more sensors and from two, three, five, ten or more systems. That data and/or information determined from the data may be a value or other indication of the rate, level, rate of change, acceleration, position, change in position, chemical makeup, or other measurable information of any variable of a well operation.

The monitoring module 80 receives and processes data from the sensing system 70 or from other suitable sources and monitors the drilling system and conditions based on the received data. As previously described, the data may be from any suitable source, or combinations of sources and may be received in any suitable format. In one embodiment, the monitoring system 80 comprises a parameter calculator 81, a parameter validator 82, a drilling state determination detector 84, an event recognition module 86, a database 96, a flag log 94, and a display/alarm module 97. It will be understood that the monitoring system 80 may include other or different programs, modules, functions, database tables and entries, data, routines, data storage, and other suitable elements, and that the various components may be otherwise integrated or distributed between physically disparate components. In a particular embodiment, the monitoring module 80 and its various components and modules may comprise logic encoded in media. The logic may comprise software stored on a computer-readable medium for use in connection with a general purpose processor, or programmed hardware such as application-specific integrated circuits (ASIC), field programmable gate arrays (FPGA), digital signal processors (DSP) and the like.

The parameter calculator 81 derives/infers or otherwise calculates state indicators for drilling operations based on reported data for use by the remainder of monitoring system 80. Alternatively, the calculations could be conducted by processes or units within the sensing systems themselves, by an intermediary system, the drilling state detector 84, or by the individual module of the monitoring system 80. A state indicator is a value or other parameter based on sensed data and is indicative of the state of drilling operations. In one embodiment, the state indicators comprise measured depth (MD), hook load (HKLD), bit position (BPOS), stand pipe pressure (SPP), and rotary table revolutions per minute (RPM).

The state indicators, either directly reported or calculated via calculator 81 and other parameters, may be received by the parameter validator 82. The parameter validator 82 recognizes and eliminates corrupted data and flags malfunctioning sensor devices. In one embodiment, the parameter validation compares each parameter to a status and/or dynamic allowable range for the parameter. The parameter is flagged as invalid if outside the acceptable range. As used herein, each means every one of at least a subset of the identified items. Reports of corrupted data or malfunctioning sensor devices can be sent to and stored in flag log 94 for analysis, debugging, and record keeping.

The validator 82 may also smooth or statistically filter incoming data. Validated and filtered parameters may be directly utilized for event recognition, or may be utilized to determine the state drilling operations of the rig 10 via the drilling state determination detector 84.

The drilling state determination detector 84 uses combinations of state indicators to determine the current state of drilling operations. The state may be determined continuously at a suitable update rate and in real time. A drilling state is an overall conclusion regarding the status of the well operation at a given point in time based on the operation of and/or parameters associated with one or more key drilling elements of the rig. Such elements may include the bit, string, and drilling fluid.

In one embodiment, the drilling state determinator modules 84 stores a plurality of possible and/or predefined states for drilling operations for the rig 10. The states may be stored by storing a listing of the states, storing logic differentiating the states, storing logic operable to determine disparate states, predefining disparate states or by otherwise suitably maintaining, providing or otherwise storing information from which disparate states of an operation can be determined. In this embodiment, the state of drilling operations may be selected from the defined set of states based on the state indicators. For example, if the bit is substantially off bottom, there is no substantial rotation of the string, and drilling fluid is substantially circulating, then based on this set of state indicators, drilling state detector 84 determines the state of drilling operations to be and/or described as circulating off bottom. On the other hand, if the drill bit is moving into the hole and the string is rotating, but there is no circulation of drilling fluid, the state of drilling operations can be determined to be and/or described as working pipe. Examples and explanations of these and other drilling states and their determination by the drilling state determination module 84 may be found in reference to FIGS. 4 and 5. The states may be stored locally and/or remotely, may be titled or untitled, may be represented by any suitable type of signal and may be determined mathematically, by comparisons, by logic trees, by lookups, by expert systems such as an inferencing engine and in any other suitable manner. The states may be sections or parts of a continuous spectrum. Thus, for example, the state may be determined by selection of a predefined state based on matching criteria and/or one or more comparisons. The state may be determined repetitively, continuously, substantially continuously or otherwise. A process is substantially continuous when it is continuous for a majority of processes for a well operation and/or cycles on a periodic basis on the order of magnitude of a second, or less.

The event recognition module 86 receives drilling parameters and/or drilling state conclusions and recognizes or flags events, or conditions. Such conditions may be alert conditions such as hazardous, troublesome, problematic or noteworthy conditions that affect the safety, efficiency, timing, cost or other aspect of a well operation. For drilling operations, drilling events comprise potentially significant, hazardous, or dangerous happenings or other situations encountered while drilling that may be important to flag or bring to the attention of a drilling supervisor. Events may include stuck pipe, pack off, or well control events such as kicks.

The event recognition module 86 may comprise sub-modules operable to recognize different kinds of events. For example, well control events such as kick-outs may be recognized via operation of well control sub-module 88. A well control event is any suitable event associated with a well that can be controlled by application or adjustment of a well fluid, flow, volume, or device such as circulation of fluid during drilling operations. Pack-off events, such as, for example, when drill cuttings clog the annulus, may be recognized via operation of pack-off sub-module 90, and stuck pipe events may be recognized via operation of stuck pipe sub-module 92. Other events may be useful to recognize and flag, and the event recognition module 86 may be configured with other modules with which this is accomplished. Control evaluation and/or decisions may be performed continuously, repetitively and/or substantially continuously as previously described. In another embodiment, the state and event recognition may be performed in response to one or more predefined events or flags that arise during the well operation.

Drilling parameters, drilling states, event recognitions, and alert flags may be displayed to the user on display/alarm module 97, stored in database 96, and/or made accessible to other modules within monitoring system 80 or to other systems or users as appropriate. Database 96 may be configured to record trends in data over time. From these data trends it may be possible, for example, to infer and flag long-term effects such as bore-hole degradation caused by repeated tripping within the bore hole.

In operation, the monitoring system 80 may allow for an increase in quality control with respect to sensing devices and the monitoring of the timing and efficiency of drilling operations. Events such as kickouts may be accurately detected and flagged while drilling earlier than is possible via human observation of rig operations, thus resulting in the more effective taking of corrective operations and a reduction in the frequency and severity of undesirable events. In addition, the provisioning of state information may allow false alarms to be minimized, more accurate event recognition and residual down time. Another potential benefit may be an increased ability to automate daily and end-of-well reporting procedures.

The states may be determined, control evaluation provided, and/or events recognized without manual or other input from an operator or without direct operator input. Operator input may be direct when the input forms a state indicator used directly by the state engine. In addition, the state, evaluation and recognition processes may be performed without substantial operator input. For example, processes may run independently of operator input but may utilize operator overrides of erroneous readings or other analogous inputs during instrument or other failure conditions. It will be understood that a process may run independently of operator input during operation and/or normal operation and still be manually, directly, or indirectly started, initiated, interrupted or stopped. With or without operator input, the state recognition processes are substantially based on instrument sensed parameters that are monitored in real-time and dynamically changing.

Figure 3:
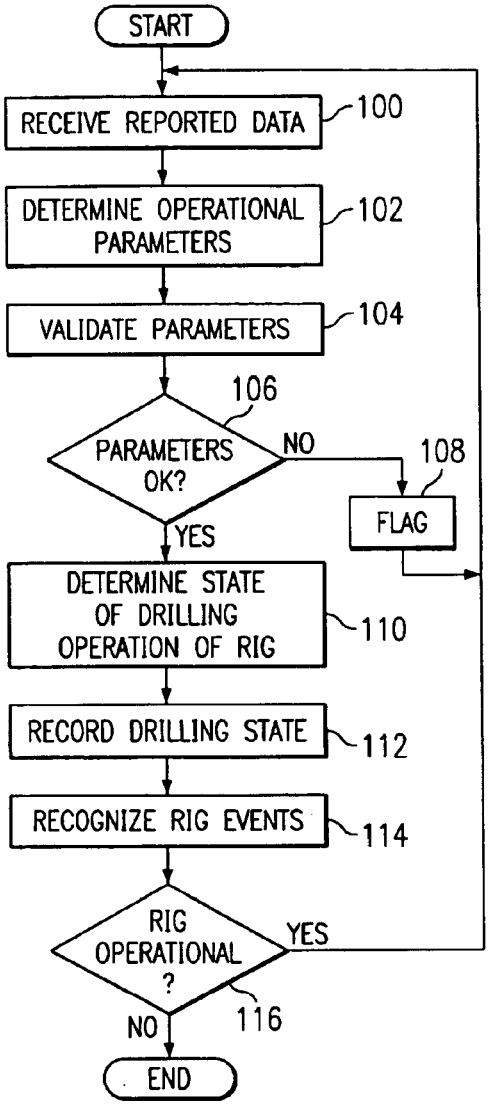
FIG. 3 is a flow diagram illustrating a method for monitoring a drilling operation in accordance with one embodiment of the present invention.

FIG. 3 illustrates a method for monitoring a rig in accordance with one embodiment of the present invention. In this embodiment, the state of drilling operation is determined and drilling events are recognized based on operational data and the drilling state. It will be understood that events may be otherwise determined or suitably recognized and that drilling may be otherwise suitably monitored without departing from the scope of the present invention.

Referring to FIG. 3, the method begins at step 100 with the receipt of reported data by the monitoring system 80, while the rig is operating. The data may be from the lifting gear system 72, the drilling fluid system 74, the rotary system 76, the driller/operator system 78 and/or from other sensors or systems of the drilling rig 10. Some of the data may constitute parameters usable in their present form or format. In other cases, state indicators or other parameters are calculated from the reported data at step 102.

At step 104, the parameters are validated and filtered. Validation may be accomplished by comparing the parameters to pre-determined or dynamically determined limits, and the parameters used if they are within those limits. Filtering may occur via the use of filtering algorithms such as Butterworth, Chebyshev type I, Chebyshev type II, Elliptic, Equiripple, least squares, Bartlett, Blackman, Boxcar, Chebyshev, Hamming, Hann, Kaiser, FFT, Savitzky Golay, Detrend, Cumsum, or other suitable data filter algorithms.

Next, at decisional step 106, for any data failing validation, the No branch of decisional step 106 leads to step 108. At step 108, the invalid data is flagged and recorded in the flag log. After flagging, step 108 leads back to step 100. Determinations based on inputs for which invalid data was received may be omitted during the corresponding cycle. Alternatively, a previous value of the input may be used, or a value based on a trend of the input may be used.

Returning to decisional step 106, for those parameters that are validated, the Yes branch leads to step 110. At step 110, validated and filtered operational parameters may be utilized to determine the state of drilling operations of the rig 10. The drilling state determined at step 110 and data trends may be recorded in the database 96 at step 112. At step 114, drilling state information and operational parameters are utilized to recognize drilling events, as described above.

Proceeding to decisional step 116, if the rig 10 remains in operation, the Yes branch returns to step 100 and continues the method as long as the rig is operational. If the rig 10 is deactivated or otherwise not operational, the No branch of decisional step 116 leads to the end of the process. The process may be operated once or more times per second, or at other suitable intervals. In this way, continuous and real time monitoring of drilling operations may be provided.

Figure 4:
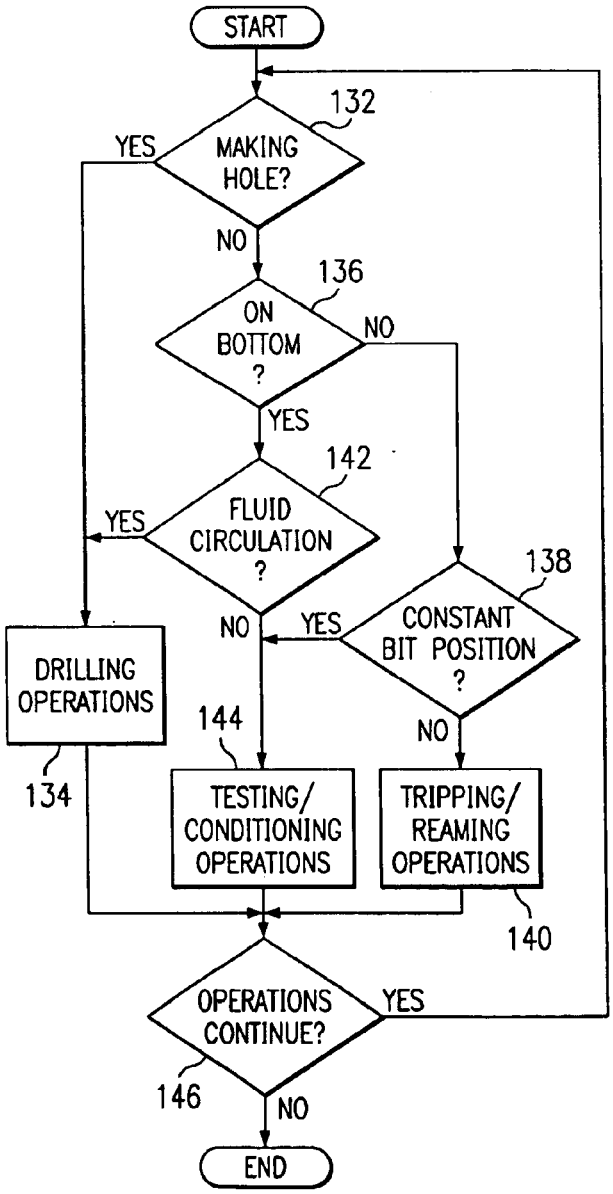
FIG. 4 is a flow diagram illustrating a method for determining the state of a drilling operation in accordance with one embodiment of the present invention.

FIG. 4 illustrates a method for determining the state of drilling operations for the drilling rig 10 in accordance with one embodiment of the present invention. In this embodiment, the drilling states of the drilling rig 10 may comprise and/or be divided into three general categories: (1) drilling; (2) testing/conditioning operations; and (3) tripping/reaming. The drilling state or states include those where the rig 10 is operating so as to drill through the earth or to attempt to do so by the rotation of the drilling bit 40. Drilling may include jetting, or washing, in part, in whole or otherwise as well as any operation operable to bore through the earth and/or remove earth from a bore hole. Jetting may be using mainly hydraulic force for rock destruction. Thus, drilling may include hammer/percussion and laser drilling. It will be understood that unsuccessful drilling may be a separate state or states. The testing/conditioning state or states are operations (other than tripping or reaming operations) used to check or test certain aspects of equipment performance, change out bits, line, or other equipment, change to a different drilling mud, condition a particular part of the bore annulus, or similar operations. The tripping/reaming state or states are operations that include the travel of the bit up or down the already-drilled bore hole.

In the embodiment shown in FIG. 4, four types of state indicators are considered by the drilling state detector 84 in determining the state of drilling operations: (1) whether the rig is "making hole" (substantially increasing the total length of the bore hole), (2) whether the bit is substantially on bottom, (3) whether the bit position is substantially constant, and (4) whether there is substantial circulation of the drilling fluid.

Referring to FIG. 4, the method begins at step 132 in which the parameter calculator 81, drilling state detector 84, or other logic determines whether the drilling rig 10 is making hole. This may be done by determining whether the measured depth of the hole is increasing. If hole is being made, the Yes branch of decisional step 137 leads to step 134. At step 134, the drilling state detector 84 determines that drilling operations are occurring.

Returning to decisional step 132, if hole is not being made, the No branch leads to decisional step 136. At step 136, the detector 84 determines whether the drill bit is at bottom of the bore hole 32. In one embodiment, the drill bit is at the bottom of the bore hole if the measured depth is equal to bit position.

If the bit is on the bottom, the Yes branch of decisional step 136 leads to decisional step 142, where detector 84 determines whether drilling fluid is circulating through the drill string 30, out of the drill bit 40, and through the rest of the fluid system. Parameters used for making this determination may include stand pipe pressure (SPP), strokes per minute (SPM) of the mud pump, total strokes, inflow rate, outflow rate, triptank level, mud pit level, or other suitable hydraulic parameters. A lower limit of these parameters may be chosen for making the determination; for example, experience may show that a SPP of greater than twenty psi is indicative that the drilling fluid is substantially circulating within the hydraulic system.

If circulation is occurring at decisional step 142, detector 84 concludes that drilling operations are occurring, suggesting that relatively strong rock at the bottom of the bore is resulting in a situation where drilling operations are occurring, but little or no hole is being made. Accordingly, the Yes branch of decisional step 142 leads to step 134.

Returning to decisional step 142, if there is not circulation, the method concludes at step 144 that the drilling state of the rig 10 is undergoing testing/conditioning operations.

Returning to decisional step 136, if the bit is not on the bottom, the No branch leads to decisional step 138 wherein it is determined whether bit position within the hole is constant; that is, whether the position of the bit relative to the terminus of the bore is remaining constant. If the bit position is constant, the Yes branch leads to step 144 where, as previously described, it is determined that the drilling state of the rig 10 is undergoing testing/conditioning operations. Returning to decisional step 138, if the bit position is not constant, the No branch leads to step 140. At step 140, the drilling state is determined to be tripping and/or reaming operations.

After the drilling state of the rig is determined based on steps 134, 144, or 140, the process leads to decisional step 146, where it is determined whether operations continue. If operations continue, the Yes branch returns to decisional step 132, where the drilling state of the rig continues to be determined as long as the operations continue. If operations are at an end, the No branch of decisional step 146 leads to the end of the process where the drilling state is determined repetitively and/or substantially continuously and in real and/or near real time.

It will be understood that other, additional or a subset of these states may be used for drilling operations. For example, in another embodiment, the states may comprise a drilling/reaming state indicating formation or other material being removed from a bore hole, a tripping state indicating tripping in or out of the hole, a testing/condition state indicating those operations and a connection/maintenance state indicating a process interruption. In still another embodiment, as described in connection with FIG. 5, the state detector 84 may have a high resolution or granularity with five, ten, fifteen or more states. As previously described, the resolution, and thus number and type of states is preferably selected to support control evaluation, decision making and/or provide process evaluation. Process evaluation may be evaluation of parameters, information and other data in the control and decision making context. For example, process evaluation may provide indications and warnings of hazardous events. Data and/or state reporting for archiving may also be provided.

FIGS. 5A–B illustrate a method for determining the drilling state of the drilling rig 10 in accordance with another embodiment of the present invention. In this embodiment, granularity of the drilling states is increased to support enhanced monitoring, reporting, logging and event recognition capabilities. In particular, each of the drilling operations state, the testing/conditioning operations state, and the tripping/reaming operations state are subdivided into a plurality of states.

In one embodiment, drilling state is subdivided into rotary drilling state (stated simply as "drilling" on FIG. 5) and sliding state. Rotary drilling occurs when the rotation of the bit 40 is caused at least in part by the rotation of the drill string 30 which, in turn, is caused by the rotation of the rotary table 56 or other device. In sliding, bit rotation is caused by the operation of a down hole bit motor or turbine rather than by the rotation of the drill string 30. In one embodiment, rotary drilling may include sliding and washing and sliding may include washing.

Likewise, testing/conditioning operations are subdivided into an in slips state, a slip and cut line state, a flow check on bottom state, a bore hole conditioning state, a circulating off bottom state, a parameter check state, and a flow check off bottom state.

In slips occurs when the string 30 is set in slips and the string weight is off the hook 24. This state typically occurs during connections and rig-idle situations. Slip and cut line occurs when the string is set in slips and the travelling block assembly is removed so as to, for example, replace worn drilling line. Flow check on bottom occurs when drilling fluid 46 is not circulating and the bit position is on bottom and static. Bore hole conditioning occurs when drilling fluid 46 is circulating, bit position is static and off bottom, and string 30 is rotating. Bore hole conditioning typically occurs when the well bore 32 is being conditioned by cleaning out cuttings or other resistance in the drill pipe/bore-hole-wall annulus. Circulating off bottom occurs when the bit 40 is off bottom, there is no rotation of the string 30, and drilling fluid 46 is circulating. Circulating off bottom typically occurs when mud is changed, fluid pills are placed, or if the well is cleaned out. Parameter check occurs when the string 30 is off bottom and rotating, and drilling fluid 46 is not circulating. Hook load may be measured during parameter check to be used for torque and drag simulations. Flow check off bottom occurs when drilling fluid 46 is not circulating and bit position is static and off bottom. Flow check off bottom typically occurs during a check to determine if the well is flowing (gaining formation fluid) or losing (drilling mud is flowing into formation).

Tripping/reaming operations can be subdivided into a tripping in hole (TIH) state, a tripping out of hole (TOH) state, a reaming while TIH state, a reaming while TOH state, a working pipe state, a washing while TIH state, and a washing while TOH state.

Tripping in hole (TIH) occurs when re-entering a hole after pulling back to the surface. Alone, the term describes TIH with no rotation and no circulation. Tripping out of hole (TOH) occurs when pulling bit off bottom for a short or round trip to surface. Alone, the term describes TOH with no rotation and no circulation. Reaming occurs when the drill bit is moving into the hole, drilling fluid is circulating, and string is rotating. Reaming while TIH is typically used in order to clean out cuttings or other obstructions. Reaming while TOH ("back reaming") is used with dedicated back-reaming tools to clean out sedimented cuttings or obstructions. Working pipe (while TIH or TOH) occurs when the drill bit is moving into the hole, string is rotating, but there is no circulation of drilling fluid. Working pipe is typically used to manage stabilizers or to move the bit past restrictions or ease the movement of the drill string in horizontal well-sections. Washing (while TIH or TOH) occurs when the drill bit is moving into the hole, string is not rotating, and drilling fluid is circulating. Washing while TIH typically is utilized to wash out cuttings before setting the bit on bottom for drilling.

Referring to FIG. 5, the method begins at step 152 where it is determined, similar to the embodiment described in FIG. 4, whether the rig is making hole. Specifically, step 152 may make this determination by determining whether or not the measured depth is increasing. If measured depth is increasing, the method then determines at step 172 whether the RPM of the rotary table are greater than or equal to one. If the RPM of the rotary table is greater than or equal to one, it is determined at step 194 that rotary table drilling is occurring. If the RPM is less than one at decisional step 172, then it is determined that the rig is sliding.

Returning to decisional step 152, if the measured depth is not increasing, it is next determined at decisional step 154 if the bit position is equal to the measured depth. If the bit position is equal to the measured depth, then at step 164 it is determined whether there is circulation. In the illustrated embodiment, the parameter of stand pipe pressure is used to determine the circulation parameter such that if the stand pipe is greater than or equal to twenty pounds per square inch (psi), then circulation of drilling fluid is determined to be occurring.

At decisional step 174, it is determined whether or not the RPM of the rotary table is greater than or equal to one. Again, if the RPM is greater than or equal to one, the rig is determined to be (rotary table) drilling and if the RPM is not greater than or equal to one, the rig is determined to be sliding in accordance with steps 198 and 200, respectively. Returning to step 164, if the stand pipe pressure is less than twenty psi, then the drilling behavior is determined at step 212 to be flow check on bottom.

Returning to step 154, if the bit position does not equal measured depth, then at step 156 it is determined whether or not the bit position is constant. If the bit position is constant, at step 160 it is next determined whether the hook load is greater than bit weight. If the hook load is greater than bit weight, at step 166 it is determined whether the stand pipe pressure is greater than or equal to twenty psi. If the stand pipe pressure is greater than or equal to twenty psi, then at step 176 it is determined whether the RPM is greater than or equal to one. If the RPM is greater than or equal to one, the drilling behavior is determined to be bottom hole conditioning at step 204. If the RPM is not greater than or equal to one, then, at step 206, the status is determined to be circulating off bottom.

Returning to step 166, if the stand pipe is less than twenty psi, then, at step 178, it is determined whether the RPM is greater than or equal to one. If the RPM is greater than or equal one, at step 208, the drilling behavior is determined to be parameter check. If the RPM is not greater than or equal to one, the drilling behavior is determined at step 210 to be flow check off bottom.

Returning to decisional step 160, if the hook load is not greater than the bit weight, it is next determined at step 162 whether the hook load equals the bit weight. The hook load may equal bit weight if it is the same or substantially the same as the bit weight or within specified deviation of the bit weight. If the hook load equals the bit weight, the drilling behavior is determined to be in slips at step 190. If the hook load does not equal the bit weight, at step 192, the drilling behavior is determined to be in slips with the line cut above the slips.

Returning to decisional step 156, if the bit position is not constant, it is next determined at decisional step 158 whether the bit position is increasing. If the bit position is increasing, then at step 168 it is determined whether the RPM is greater than or equal to one. If the RPM is greater than or equal to one, at step 180 it is determined whether the stand pipe pressure is greater than or equal to twenty psi. If the stand pipe pressure is greater than or equal to twenty psi, the drilling behavior is determined to be reaming while tripping in hole at step 212. If the stand pipe pressure is less than twenty psi, then at step 214 the status is determined to be working pipe while tripping in hole.

If the RPM is less than one at decisional step 168, it is then determined at step 182 whether the stand pipe pressure is greater than or equal to twenty psi. If the stand pipe pressure is greater than or equal to twenty psi, the status is determined to be washing while tripping in hole at step 216. If the stand pipe pressure is less than twenty psi, the status is determined to be tripping in hole at step 218.

Returning to decisional step 158, if the bit position is not increasing, it is next determined at step 170 whether the RPM is greater than or equal to one. If the RPM is greater than or equal to one, at step 184, it is determined whether the stand pipe pressure is greater than or equal to twenty psi. If the stand pipe pressure is greater than or equal to twenty psi, at step 220 the status is determined to be back reaming. If the stand pipe pressure is less than twenty psi, at step 222 the status is determined to be working pipe while tripping out of hole.

Returning to decisional step 170, if the RPM is not greater than or equal to one, at step 186, if the stand pipe pressure is greater than or equal to twenty psi, then the drilling behavior is at step 224 determined to be washing while tripping out of hole. If the stand pipe pressure is less than twenty psi at step 186, the drilling behavior is at step 226 determined to be tripping out of hole. After the drilling behavior has been determined, it is next determined at step 228 whether or not operations continue. If operations continue, then parameters continue to be entered into the system and the determination method continues. If operations are not continuing, then the method has reached its end.

FIG. 6 illustrates states of a well operation in accordance with another embodiment of the present invention. In this embodiment, the state of a drilling or other well operation may include hierarchal states with parent and child states. For example, a drilling or other well operation 250 may have a productive state 252 and a non-productive state 254. For drilling operations, the productive state 252 may include processes in which hole is being made, the bit is advancing or is operated so as to advance. In a particular embodiment, the productive state may include and/or have drilling 260, sliding 262 and/or jetting 264 or combination states as described in connection with FIG. 5. In some drilling embodiments, reaming may be included in the productive state. In other well operations, the productive state may be the state that is the focus or ultimate purpose of the well operation.

The non-productive state 254 may include support or other processes that are planned, unplanned, needed, necessary or helpful to the production state or states. The non-productive state may include and/or have a planned state 270 and an unplanned state 272. For drilling operations, the unplanned state 272 may include and/or have a conditioning state 280 and a testing state 282. The planned state may include and/or have a tripping state 290 as well as a connection state 292 and a maintenance state 294. Maintenance may include rig and hole maintenance. It will be understood that some operations, such as tripping may have aspects in both planned and unplanned states. The states may be determined based on state indicators and data as previously described with the parent and/or child states being determined and used for process evaluation. The parent states may be determined based on the previously discussed state indicators of the included, or underlying, child states, a subset of the indicators or otherwise. Thus, for example, the drilling operation 250 may have the productive state 252 if measured hole depth is increasing or if bit position is equal to measured hole depth and stand pipe pressure is greater than or equal to 20 psi. Maintenance may, for example, include hole maintenance such as reaming and/or rig maintenance such as slip and cut line.

Although the present invention has been described with reference to drilling rig 10 and the corresponding states of drilling operations, the invention may be used to determine one or more states associated with other suitable petroleum and geosystem operations for a well. Such well operations may include work-over procedures, well completions, natural-gas operations, well testing, cementing, well abandonment, well stimulation, acidizing, squeeze jobs, wire line applications and water/fluid treatment.

For example, mud fluid circulation systems generally include a series of stages that may be identified by using mechanical and hydraulic data as feedback from the associated system. Mud fluid circulation systems are generally used to maintain hydrostatic pressure for well control, carry drill cuttings to the surface, and cool and/or lubricate the drill bit during drilling. The mud or water used to make up the drilling fluid may require treatment to remove dissolved calcium and/or magnesium. Soda ash may be added to form a precipitate of calcium carbonate. Caustic soda (NaOH) may also be added to form magnesium hydroxide. Accordingly, fluid characteristics (such as pressure and fluid-flow rate) and chemical-based parameters may be suitably monitored in accordance with the teachings of the present invention in order to determine one or more of the identified states or other states of the operations.

In addition, production procedures and activities (such as fracs, acidizing, and other well-stimulating techniques) represent another example of petroleum operations within the scope of the present invention. Production operations may encompass any operations involved in bringing well fluids (or natural gas) to the surface and may further include preparing the fluids for transport to a suitable refinery or a next processing destination, and well treatment procedures used generally to optimize production. The first step in production is to start the well fluids flowing to the surface (generally referred to as "well completion"). Well servicing and workover consists of performing routine maintenance operations (such replacing worn or malfunctioning equipment) and performing more extensive repairs, respectively. Well servicing and workover are an intermittent step and generally a prerequisite in order to maintain the flow of oil or gas. Fluid may be then separated into its components of oil, gas, and water and then stored and treated (for purification), suitably measured, and properly tested where appropriate before being transported to a refinery. Well workovers may additionally involve recompletion in a different pay zone by deepening the well or by plugging back. In accordance with the teachings of the present invention, each of these procedures may be monitored such that feedback is provided in order to determine one or more of the identified states or other states of the corresponding operation.

Additionally, well or waste treatments represent yet another example of petroleum operations that include various stages that may be identified with use of the present invention. Well or waste treatments generally involve the use of elements such as: paraffin, slop oil, oil and produced water-contaminated soils. In well or waste treatments, purification and refinement stages could provide suitable feedback in offering mechanical data for selecting a corresponding state. Such states may include, for example, collecting, pre-treatment, treatment, settling, neutralization and out pumping.

Thus the monitoring system of the present invention may be used in connection with any suitable system, architecture, operation, process or activity associated with petroleum or geosystem operations of a well capable of providing an element of feedback data such that a stage associated with the operation may be detected, diagnosed, or identified is within the scope of the present invention. In these operations, the drilling rig 10 may not be on location. In these embodiments, such as in connection with frac jobs and stimulation, sensor data may be retrieved via wireline and/or mud pulses from down hole equipment and/or directly from surface equipment and systems.

In non-drilling applications, any suitable reference point may be tracked. For example, for pumping operations, pure volumetric data may be tracked and used to determine the state of operations. In all of these embodiments, the monitoring system may include a sensing system for sensing, refining, manipulating and/or processing data and reporting the data to a monitoring module. The sensed data may be validated and parameters calculated as previously described in connection with monitoring module 80. The resulting state indicators may be fed to a state determination module to determine the current state of the operation. The state is the overall conclusion regarding the status at a given point and time based on key measurable elements of the operation. For example, for frac operations, the states may include high and low pressure states, fluid and slurry pumping states, proppant states, and backwash/cleansing states. For acid jobs, the states may include flow and pressure states, pumping states, pH states, and time-based states. Well completion operations may include testing, pumping, cementing and perforating states. For each of these and other well operations, the sensing system may include fluid systems, operator systems, pumping systems, down hole systems, surface systems, chemical analysis systems, and other systems operable to measure and provide data on the well operation.

As previously described, the state determinator module may store a plurality of possible and/or predefined states for the operation. In this embodiment, the state of operations may be selected from the defined set of states based on the state indicators. Events for the operation may be recognized and flagged as previously described.

Although the present invention has been described with several embodiments, various changes and modifications may be suggested to one skilled in the art. It is intended that the present invention encompass such changes and modifications as fall within the scope of the appended claims.

What is claimed is:

1. An automated method for determining the state of a well operation, comprising:

storing a plurality of states for a well operation;

receiving mechanical and hydraulic data reported for the well operation from a plurality of systems; and determining that at least some of the data is valid by comparing the at least some of the data to at least one limit, the at least one limit indicative of a threshold at which the at least some of the data do not accurately represent the mechanical or hydraulic condition purportedly represented by the at least some of the data; and when the at least some of the data are valid, based on the mechanical and hydraulic data, automatically selecting one of the states as the state of the well operation.

2. The method of claim 1, wherein the well operation comprises a drilling operation.

3. The method of claim 2, wherein at least one of the plurality of states comprises a drilling state.

4. The method of claim 3, wherein the drilling state comprises rotary drilling.

5. The method of claim 3, wherein the drilling state comprises sliding.

6. The method of claim 2, wherein the plurality of states comprises a testing state.

7. The method of claim 6, wherein the testing state comprises a flow check on bottom.

8. The method of claim 6, wherein the testing state comprises a flow check off bottom.

9. The method of claim 6, wherein the testing state comprises a parameter check.

10. The method of claim 2, wherein at least one of the plurality of states comprises a conditioning state.

11. The method of claim 10, wherein the conditioning state comprises bottom hole conditioning.

12. The method of claim 10, wherein the conditioning state comprises circulating off bottom.

13. The method of claim 2, wherein at least one of the plurality of states comprises a tripping state.

14. The method of claim 13, wherein the tripping state comprises tripping in hole.

15. The method of claim 13, wherein the tripping state comprises reaming while tripping in hole.

16. The method of claim 13, wherein the tripping state comprises working pipe while tripping in hole.

17. The method of claim 13, wherein the tripping state comprises washing while tripping in hole.

18. The method of claim 13, wherein the tripping state comprises back reaming while tripping out of hole.

19. The method of claim 13, wherein the tripping state comprises working pipe while tripping out of hole.

20. The method of claim 13, wherein the tripping state comprises washing while tripping out of hole.

21. The method of claim 2, wherein the plurality of states comprises at least a drilling state, a testing state, and a tripping state.

22. The method of claim 2, further comprising:

determining, based on the mechanical data, whether the hole is being made; and wherein automatically selecting one of the states comprises selecting the state of the drilling operation based on whether the rig is making hole.

23. The method of claim 2, further comprising:

determining, based on the mechanical data, whether a drilling bit is on bottom; and wherein automatically selecting one of the states as the state of the well operation comprises selecting the state of the drilling operation based on whether the drilling bit is on bottom.

24. The method of claim 2, further comprising:

determining, based on the hydraulic data, whether a drilling fluid is circulating; and wherein automatically selecting one of the states as the state of the well operation comprises selecting the state of the drilling operation based on whether the drilling fluid is circulating.

25. The method of claim 2, further comprising:

determining, based on the mechanical data, whether a bit position is constant; and wherein automatically selecting one of the states as the state of the well operation comprises selecting the state of the drilling operation based on whether the bit position is constant.

26. The method of claim 2, further comprising indicating the state of the drilling operation.

27. The method of claim 2, further comprising recognizing a drilling event based on the state of the drilling operation and data reported for the drilling operation.

28. The method of claim 2, wherein at least one of the plurality of states comprises an in slips state.

29. The method claim 2, wherein at least one of the plurality of states comprises a slip and cut line state.

30. The method of claim 1, further comprising using the state of the well operation to evaluate parameters and provide control for the well operation.

31. An automated system for determining the state of a well operation comprising:

means for storing a plurality of states for a well operation;

means for determining that at least some received mechanical and hydraulic data is valid by comparing the at least some of the data to at least one limit, the at least one limit indicative of a threshold at which the at least some of the data does not accurately represent the mechanical or hydraulic condition purportedly represented by the at least some of the data; and means for automatically selecting one of the states based on mechanical and hydraulic data as the state of the well operation when the at least some of the mechanical and hydraulic data are valid.

32. The system of claim 31, wherein the well operation comprises a drilling operation.

33. The system of claim 32, wherein at least one of the plurality of the states comprises a drilling state.

34. The system of claim 33, wherein the drilling state comprises rotary drilling.

35. The system of claim 33, wherein the drilling state comprises sliding.

36. The system of claim 32, wherein the plurality of states comprises a testing state.

37. The system of claim 36, wherein the testing state comprises a flow check on bottom.

38. The system of claim 36, wherein the testing state comprises a flow check off bottom.

39. The system of claim 36, wherein the testing state comprises a parameter check.

40. The system of claim 32, wherein at least one of the plurality of states comprises a conditioning state.

41. The system of claim 40, wherein the conditioning state comprises bottom hole conditioning.

42. The system of claim 40, wherein the conditioning state comprises circulating off bottom.

43. The system of claim 32, wherein at least one of the plurality of states comprises a tripping state.

44. The system of claim 43, wherein the tripping state comprises tripping in hole.

45. The system of claim 43, wherein the tripping state comprises reaming while tripping in hole.

46. The system of claim 45, wherein the tripping state comprises working pipe while tripping in hole.

47. The system of claim 45, wherein the tripping state comprises washing while tripping in hole.

48. The system of claim 45, wherein the tripping state comprises back reaming while tripping out of hole.

49. The system of claim 45, wherein the tripping state comprises working pipe while tripping out of hole.

50. The system of claim 45, wherein the tripping state comprises washing while tripping out of hole.

51. The system of claim 32, wherein the plurality of states comprises at least a drilling state, a testing state, and a tripping state.

52. The system of claim 32, further comprising:

means for determining whether the hole is being made based on the mechanical data; and means for determining the state of the drilling operation based on whether the rig is making hole.

53. The system of claim 32, further comprising:

means for determining whether a drilling bit is on bottom based on the mechanical data; and means for determining the state of the drilling operation based on whether the drilling bit is on bottom.

54. The system of claim 32, further comprising:

means for determining whether a drilling fluid is circulating based on the hydraulic data; and means for determining the state of the drilling operation based on whether the drilling fluid is circulating.

55. The system of claim 32, further comprising:

means for determining whether a bit position is constant based on the mechanical data; and means for determining the state of the drilling operation based on whether the bit position is constant.

56. The system of claim 32, further comprising means for indicating the state of the drilling operation.

57. The system of claim 32, further comprising means for recognizing a drilling event based on the state of the drilling operation and data reported for the drilling operation.

58. The system of claim 32, wherein at least one of the plurality of states comprises an in slips state.

59. The system claim 32, wherein at least one of the plurality of states comprises a slip and cut line state.

60. The system of claim 31, further comprising means for using the state of the well operation to evaluate parameters and provide control for the operation.

61. An automated system for determining the state of a well operation, comprising:

logic encoded in media; and the logic operable to receive mechanical and hydraulic data reported for the well operation from a plurality of systems, determine that at least some of the received data is valid by comparing the at least some of the received data to at least one limit, the at least one limit indicative of a threshold at which the at least some of the received data do not accurately represent the condition purportedly represented by the at least some of the received data, and to automatically select one of the states as the state of the well operation based on the mechanical and hydraulic data when the at least some of the received data are valid.

62. The system of claim 61, wherein the well operation comprises a drilling operation.

63. The system of claim 62, wherein at least one of the plurality of states comprises a drilling state.

64. The system of claim 63, wherein the drilling state comprises rotary drilling.

65. The system of claim 63, wherein the drilling state comprises sliding.

66. The system of claim 62, wherein the at least one of the plurality of states comprises a testing state.

67. The system of claim 66, wherein the testing state comprises a flow check on bottom.

68. The system of claim 66, wherein the testing state comprises a flow check off bottom.

69. The system of claim 66, wherein the testing state comprises a parameter check.

70. The system of claim 62, wherein at least one of the plurality of states comprises a conditioning state.

71. The system of claim 70, wherein the conditioning state comprises bottom hole conditioning.

72. The system of claim 70, wherein the conditioning state comprises circulating off bottom.

73. The system of claim 70, wherein at least one of the plurality of states comprises a tripping state.

74. The system of claim 73, wherein the tripping state comprises tripping in hole.

75. The system of claim 73, wherein the tripping state comprises reaming while tripping in hole.

76. The system of claim 73, wherein the tripping state comprises working pipe while tripping in hole.

77. The system of claim 73, wherein the tripping state comprises washing while tripping in hole.

78. The system of claim 73, wherein the tripping state comprises back reaming while tripping out of hole.

79. The system of claim 73, wherein the tripping state comprises working pipe while tripping out of hole.

80. The system of claim 73, wherein the tripping state comprises washing while tripping out of hole.

81. The system of claim 62, wherein the plurality of states comprises at least a drilling state, a testing state, and a tripping state.

82. The system of claim 62, the logic further operable to:

determine whether the hole is being made based on the mechanical data; and determine the state of the drilling operation based on whether the rig is making hole.

83. The system of claim 62, the logic further operable to:

determine whether a drilling bit is on bottom based on the mechanical data; and determine the state of the drilling operation based on whether the drilling bit is on bottom.

84. The system of claim 62, the logic further operable to:

determine whether a drilling fluid is circulating based on the hydraulic data; and determine the state of the drilling operation based on whether the drilling fluid is circulating.

85. The system of claim 62, the logic further operable to:

determine whether a bit position is constant based on the mechanical data; and determine the state of the drilling operation based on whether the bit position is constant.

86. The system of claim 62, the logic further operable to indicate the state of the drilling operation.

87. The system of claim 62, the logic further operable to recognize a drilling event based on the state of the drilling operation and data reported for the drilling operation.

88. The system of claim 62, wherein at least one of the plurality of states comprises an in slips state.

89. The system claim 62, wherein at least one of the plurality of states comprises a slip and cut line state.

90. The system of claim 61, the logic further operable to use the state of the well operation to evaluate parameters and provide control for the operation.

91. An automated method for determining a state of a drilling operation comprising:

receiving mechanical and hydraulic data reported for a drilling operation;

based on the mechanical and hydraulic data, determining a state of the drilling operation; wherein the state of the drilling operation is determined to be:

drilling if:

a hole is being made; or a hole is not being made, a drill bit associated with the drilling operation is on bottom and drilling fluid associated with the drill bit is circulating;

testing/conditioning if:

a hole is not being made, the drill bit is on bottom and the drilling fluid is not circulating; or a hole is not being made, the drill bit is off bottom and the drill bit has a constant position; and tripping/reaming if:

a hole is not being made, the drill bit is off bottom and the position of the drill bit is not constant.

92. The method of claim, 91, wherein the state of the drilling operation is determined to be in slips if a hole is not being made, the drill bit is off bottom, the drill bit has a constant bit position and a hook load associated with the drilling operation is substantially equal to a block weight associated with the drilling operation.

93. The method of claim 91, wherein the state of the drilling operation is determined to be slip and cut line if a hole is not being made, the drill bit is off bottom, the drill bit has a constant bit position and a hook load associated with the drilling operation is less than a block weight associated with the drilling operation.

94. An automated method for determining the state of a well operation, comprising:

storing a plurality of states comprising at least a productive and a non-productive state for the well operation;

receiving mechanical and hydraulic data reported for the well operation; and determining that at least some of the data is valid by comparing the data to at least one limit, the at least one limit indicative of a threshold at which the at least some of the data do not accurately represent the mechanical or hydraulic condition purportedly represented by the at least some of the data; and when the at least some of the data are valid, based on the mechanical and hydraulic data, automatically selecting one of the plurality of states as the state of the well operation.

95. The method of claim 94, wherein the well operation comprises a drilling operation.

96. The method of claim 95, wherein the productive state comprises a drilling state.

97. The method of claim 96, wherein the drilling state comprises rotary drilling.

98. The method of claim 96, wherein the drilling state comprises sliding.

99. The method of claim 95, wherein the non-productive state comprises a planned state.

100. The method of claim 99, wherein the planned state comprises at least one of a connection state, a maintenance state and a tripping state.

101. The method of claim 95, wherein the non-productive state comprises an unplanned state.

102. The method of claim 101, wherein the unplanned state comprises at least one of a conditioning state and a testing state.

103. The method of claim 94, wherein the state is selected without direct input from an operator.

104. The method of claim 94, wherein the state is selected without input from an operator.

105. An automated system for determining the state of a well operation, comprising:

logic encoded in media; and the logic operable to receive mechanical and hydraulic data reported for the well operation, determine that at least some of the received data is valid by comparing the data to at least one limit, the at least one limit indicative of a threshold at which at least some of the data do not accurately represent the condition purportedly represented by the at least some of the received data, and to automatically select one of a productive state and a non-productive state as a state of the well operation based on the mechanical and hydraulic data when the at least some of the received data are valid.

106. The method of claim 105, wherein the well operation comprises a drilling operation.

107. The method of claim 106, wherein the productive state comprises a drilling state.

108. The method of claim 107, wherein the drilling state comprises rotary drilling.

109. The method of claim 107, wherein the drilling state comprises sliding.

110. The method of claim 106, wherein the non-productive state comprises a planned state.

111. The method of claim 110, wherein the planned state comprises at least one of a connection state, a maintenance state and a tripping state.

112. The method of claim 106, wherein the non-productive state comprises an unplanned state.

113. The method of claim 112, wherein the unplanned state comprises at least one of a conditioning state and a testing state.

114. The method of claim 105, wherein the state is selected without direct input from an operator.

115. The method of claim 105, wherein the state is selected without input from an operator.

* * * * *